United States Patent [19]

Harrington et al.

[11] 4,236,394

[45] Dec. 2, 1980

[54] PADLOCKS AND LOCKS IN GENERAL

[76] Inventors: Richard P. Harrington; Russell J. Harrington, both of 1930 3rd St., Alexandria, La. 71301

[21] Appl. No.: 877,226

[22] Filed: Feb. 13, 1978

[51] Int. Cl.[2] ..... E05B 37/06

[52] U.S. Cl. ..... 70/25; 70/52; 70/53

[58] Field of Search ..... 70/25, 26, 38 R, 38 A, 70/38 B, 38 C, 52, 53, 24, 21, 20

[56] References Cited

U.S. PATENT DOCUMENTS

| | | | |
|---|---|---|---|
| 2,132,201 | 10/1938 | Allman | 70/25 |
| 2,830,447 | 4/1958 | Miller | 70/25 |

*Primary Examiner*—Robert L. Wolfe

[57] ABSTRACT

A combination lock of the exposed shackle type is disclosed, including means for locking and protecting internal mechanism against tampering and means to foil unauthorized access through improved pivotally offset latch hooks that function independently to tighten into shackle notches and eventually wedge behind provided lugs on the case when latched shackle is pulled outwards. A spring loaded plunger co-operating with a reciprocal center mounting plate having an unlocking bar, a safety unlocking spring and a return locking spring. A central mounting and guide post with square tumbler shaft extending up into a center guide hole in the dial. A plurality of frictionally held combination changeable tumblers assembled upon said square shaft with sequential driving means between dial and tumbler hubs bypassing non-rotatable tumbler separating spacers; each tumbler having a gate at it's periphery to receive a provided fence. Alternate means for stopping dial rotation prior to entry of said fence into said gates as anti-feel and listen out means and alternate means for detaining the dial at each graduation to insure accurate dialing, changing of combination and positive use of a provided master combination means. A two stage opening process to fully release the shackle and erase last number dialed when either the current or master combinations are dialed. A spring loaded releasable shackle holding pin extensible into an aperture in dial underside when zero on dial is rotated to index mark on the case.

10 Claims, 12 Drawing Figures

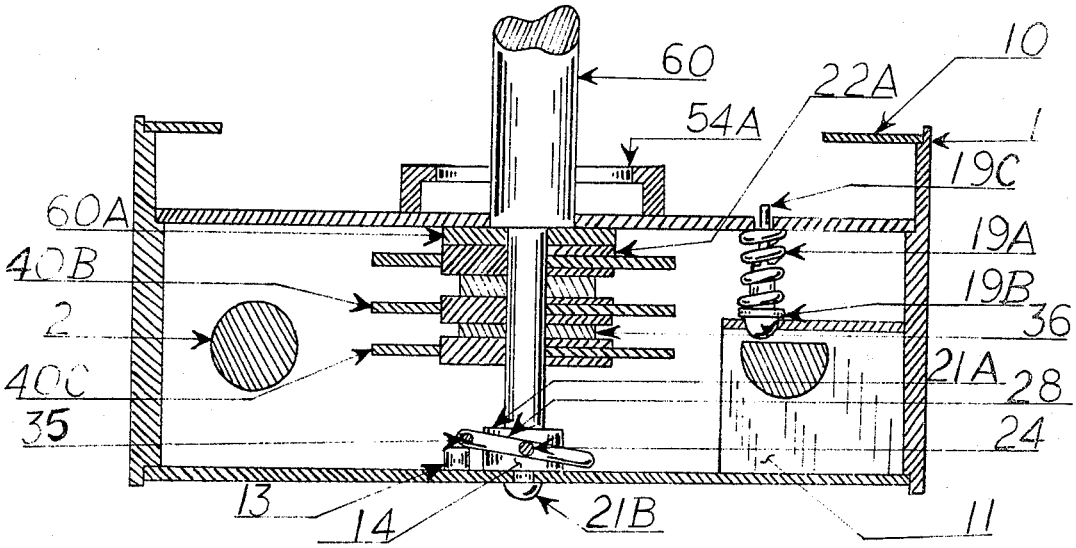
FIGURE #4
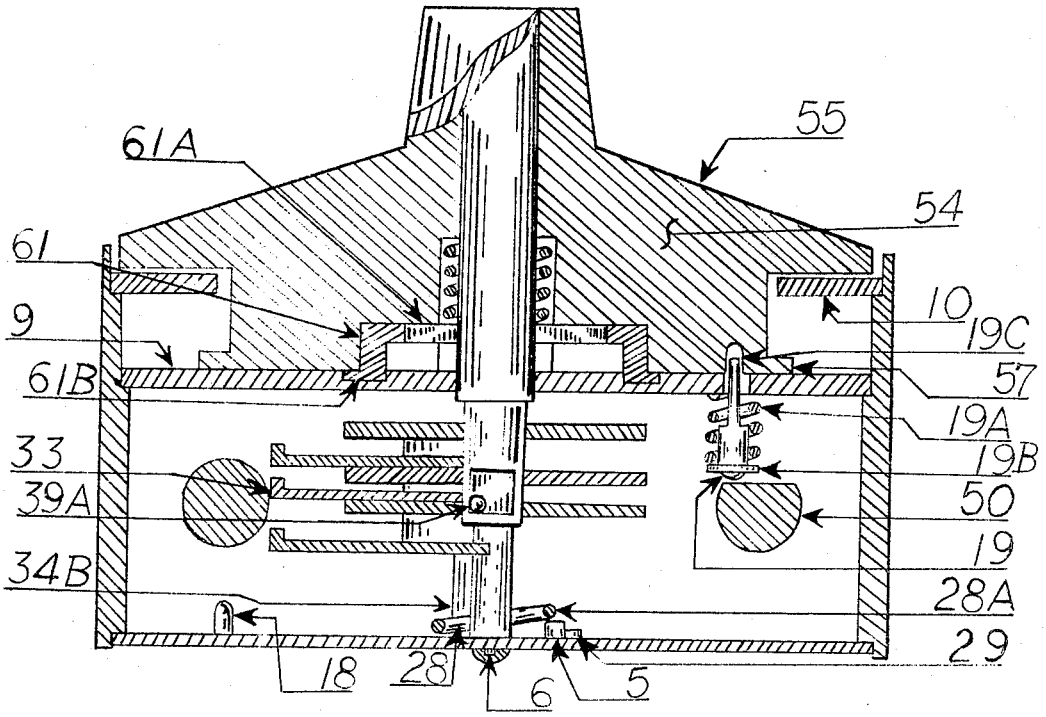
FIGURE 5

PADLOCKS AND LOCKS IN GENERAL

OBJECTS

Therefore it is an object of this invention to provide a combination lock of the type described above, wherein beveled ends of the latching hook wedge in behind matching beveled wedge blocks secured to inside of the case when the shackle is pulled or jerked outwards, thus serving to force the latch hooks tighter into the shackle natches resulting from a lost motion means associated with pivot pins of the latching members.

It is a further object of this invention to provide latching hooks that work independently, one from the other, so means devised by pick-locks for unlatching one hook will in no way serve to release the other hook, as well as providing means (through design) for blocking entry of any type or thickness of shim from catching or hooking onto or into any portion of the hooks for the purpose of moving the hooks inwards out of the shackle notches.

It is another object of this invention to provide a simple and effective means for holding the shackle legs in the case after the hooks have been properly unlatched until the dial has been returned to a preselected number (such as zero) for the purpose of erasing the last number dialed.

It is still a further object of this invention to provide effective graduation detection means during the dialing process so as to lessen the necessity of precise dialing, and to provide means for dialing the combination at night (in darkness) and for use of the lock by a blind person.

It is yet a further object of this invention to provide an anti-feel out and listen out means whereby first inward movement of the plunger and fence serves to stop the dial from rotation before the fence touches the tumbler disks in the rims of which unlocking fence gates are located.

It is a further object of this invention to provide a master combination means whereby a separate set of master combination tumblers are dialed in the same manner as is the current combination preparatory to use of means for stopping rotation of the disks and subsequent slipping of of the hubs to a preselected number of the dial and further turning of the dial to a second preselected number to open the lock.

It is another object of this invention to provide means where by the long leg of the shackle may pass completely through the lock case, to which extended end a dead bolt is secured for use as a door lock without further alterations. these and other objects, advantages and features of this invention will be apparent of those skilled in the art, from a consideration of these specifications including the attached drawings in which the following 19 figures illustrate views of working parts of the above introduced lock, which invention will hereinafter be described in detail.

FIGURES

FIG. 4 is a bottom end view with the lower half of the outer case removed to show most of the internal parts as seen from 4-4 of FIG. 3.

FIG. 5 partly in section and partly in elevation, shows master tumbler actuating and in first position and shackle release pin in second position.

Figure 1:
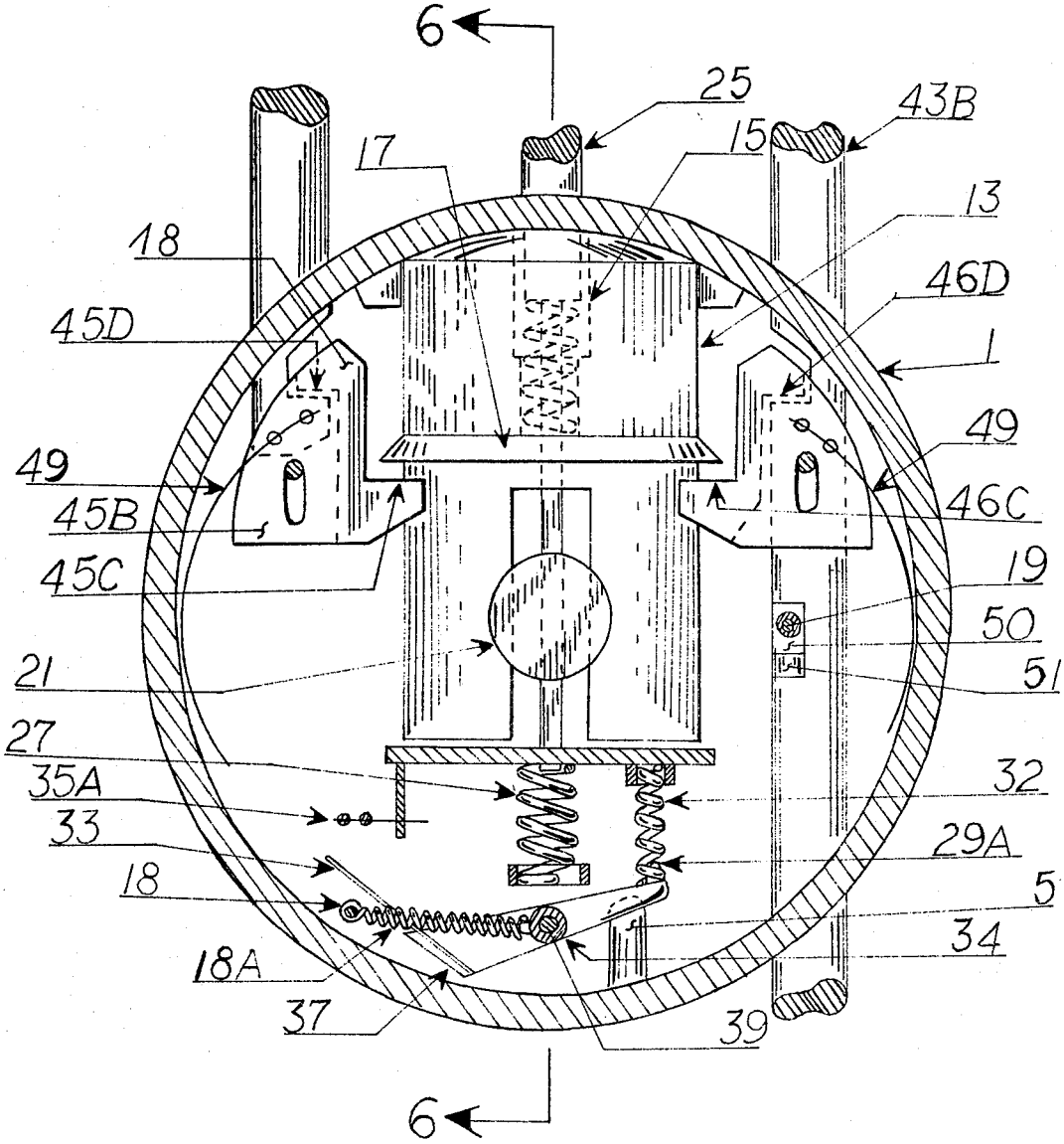
FIG. 1 is a general view from the front (dial side) showing most internal working parts with the dial and middle bearing plate removed, latching hooks seen in a first locked position.
Figure 6:
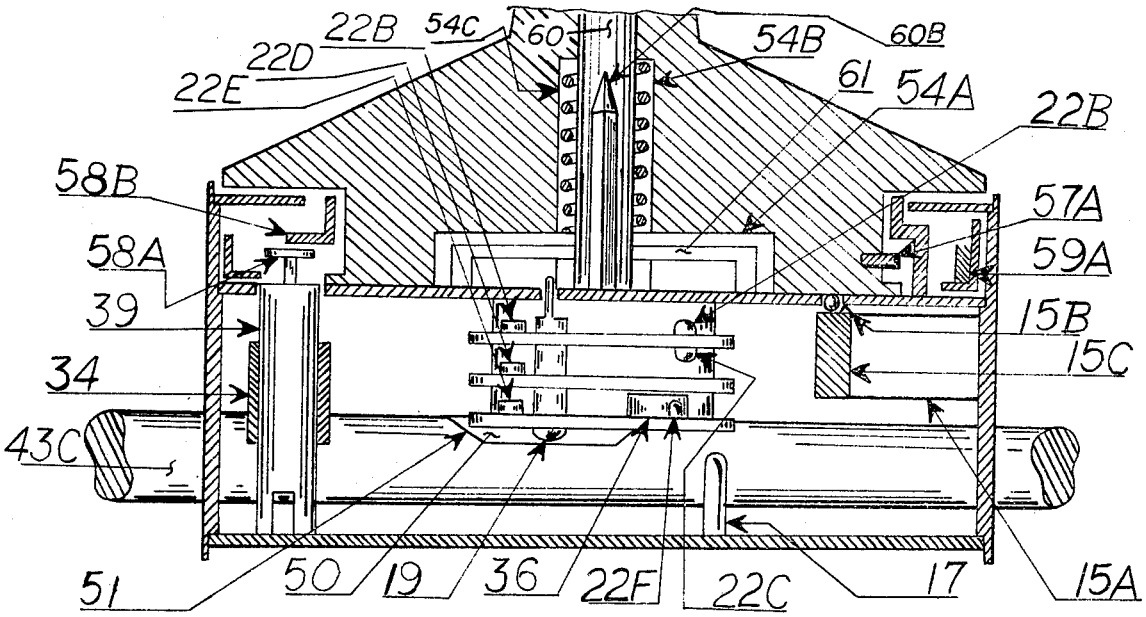

FIG. 6 is a view taken along line 6-6 of FIG. 1 showing most parts of the lock included with dial stopping ball in a first free position.

Figure 7:
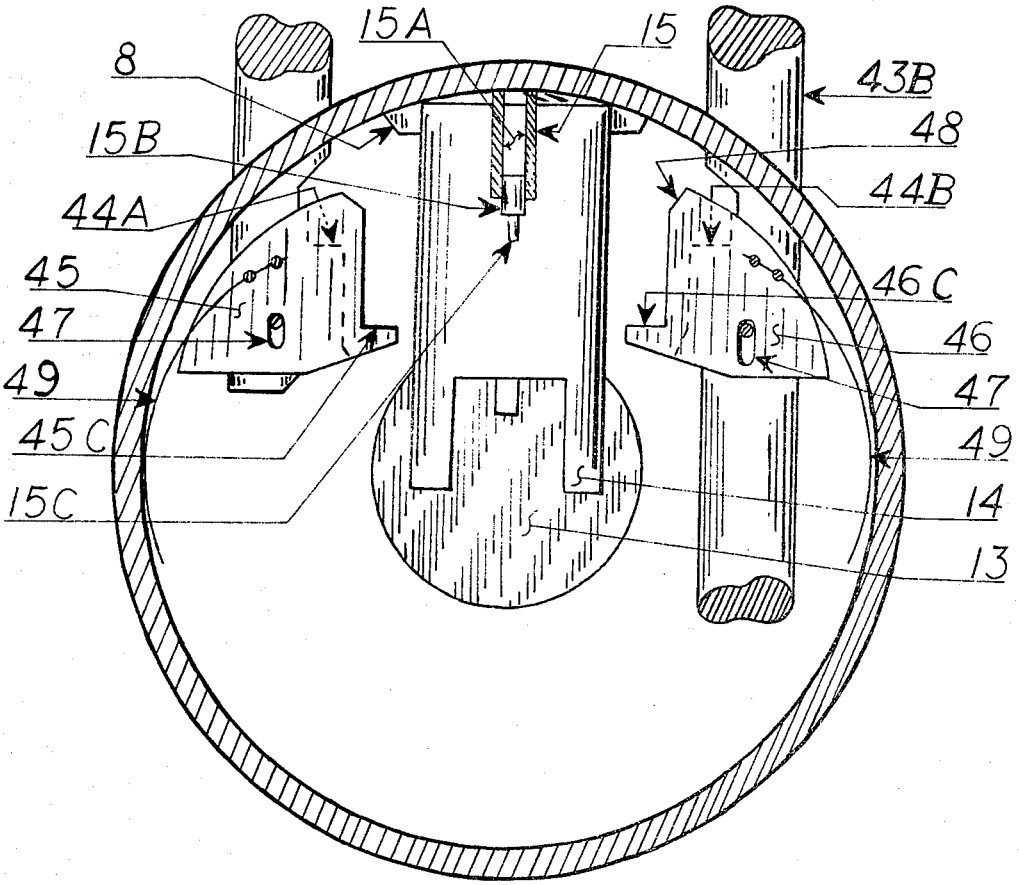

FIG. 7 is similar to FIG. 1 principally showing relative position of fence to tumblers and hooks to wedge block.

Figure 8:
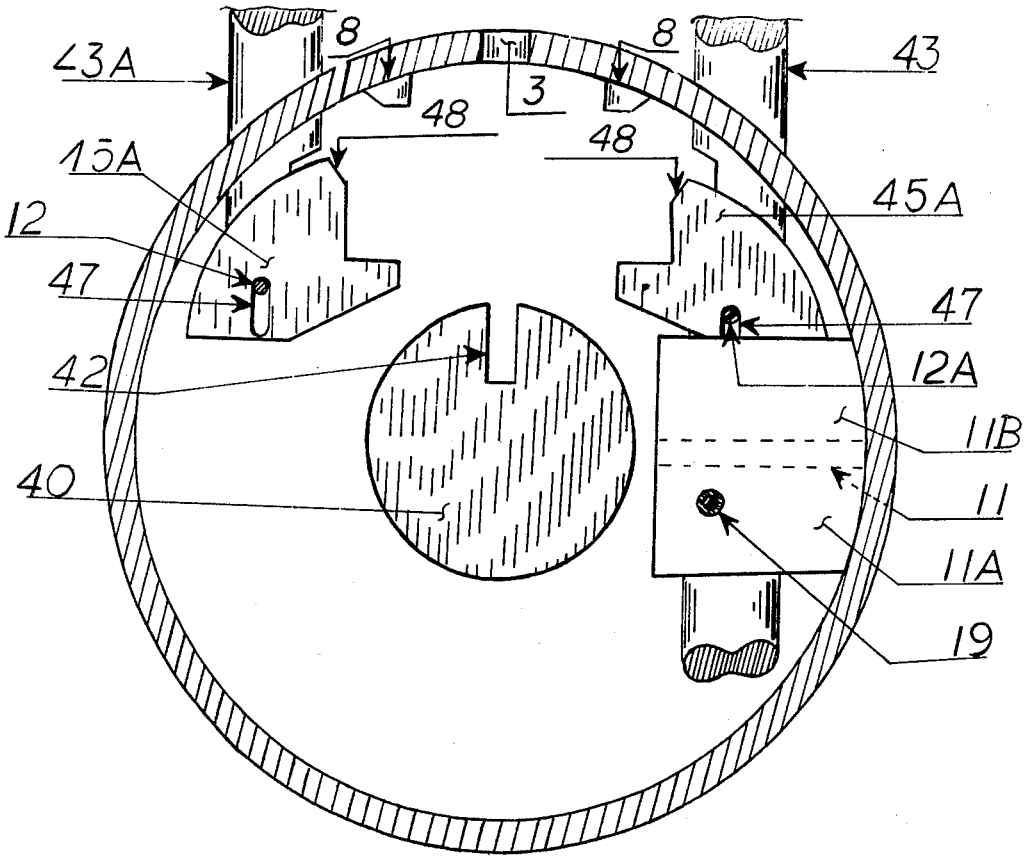

FIG. 8 is a view similar to FIG. 7 showing latching hooks in second wedged position.

Figure 9:
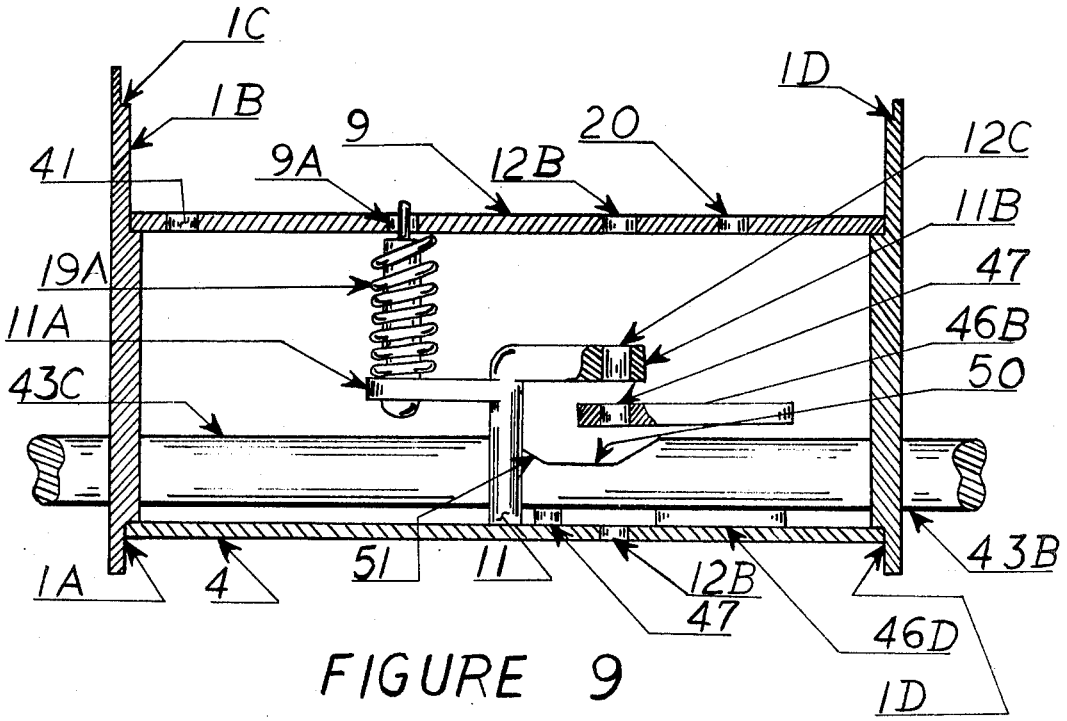

FIG. 9 partly in section and partly in elevation with right side of case removed, and shows the shackle long leg in an unlocked and free position.

Figure 10:
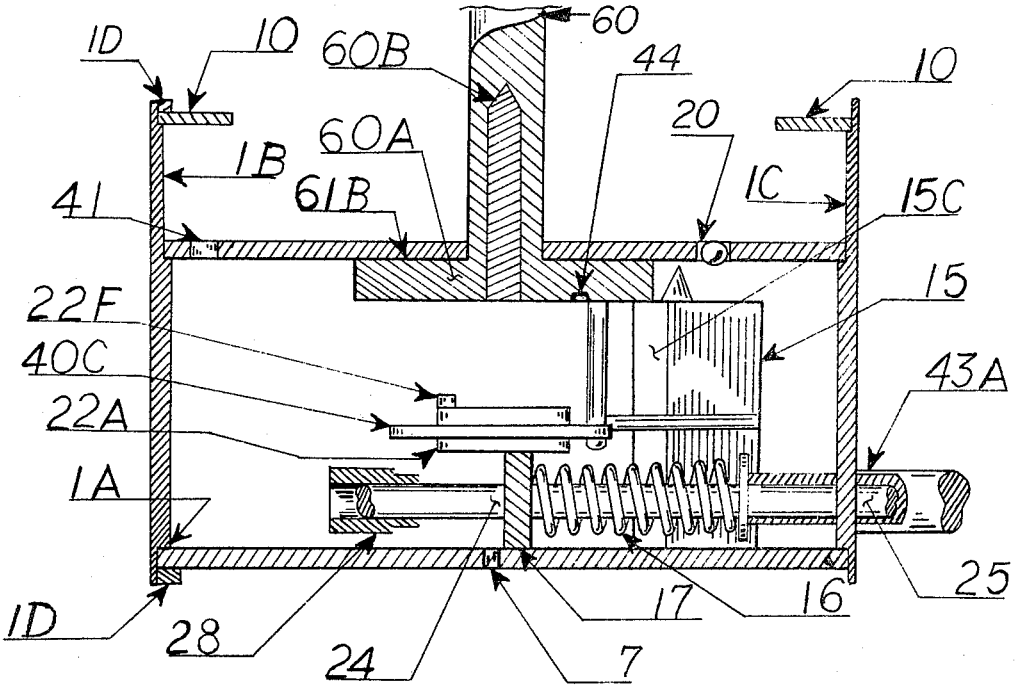

FIG. 10 partly in section and partly in elevation shows right side of case removed with fence fully engaged with the tumbler disks and dial stopping ball in the third (free) position.

Figure 11:
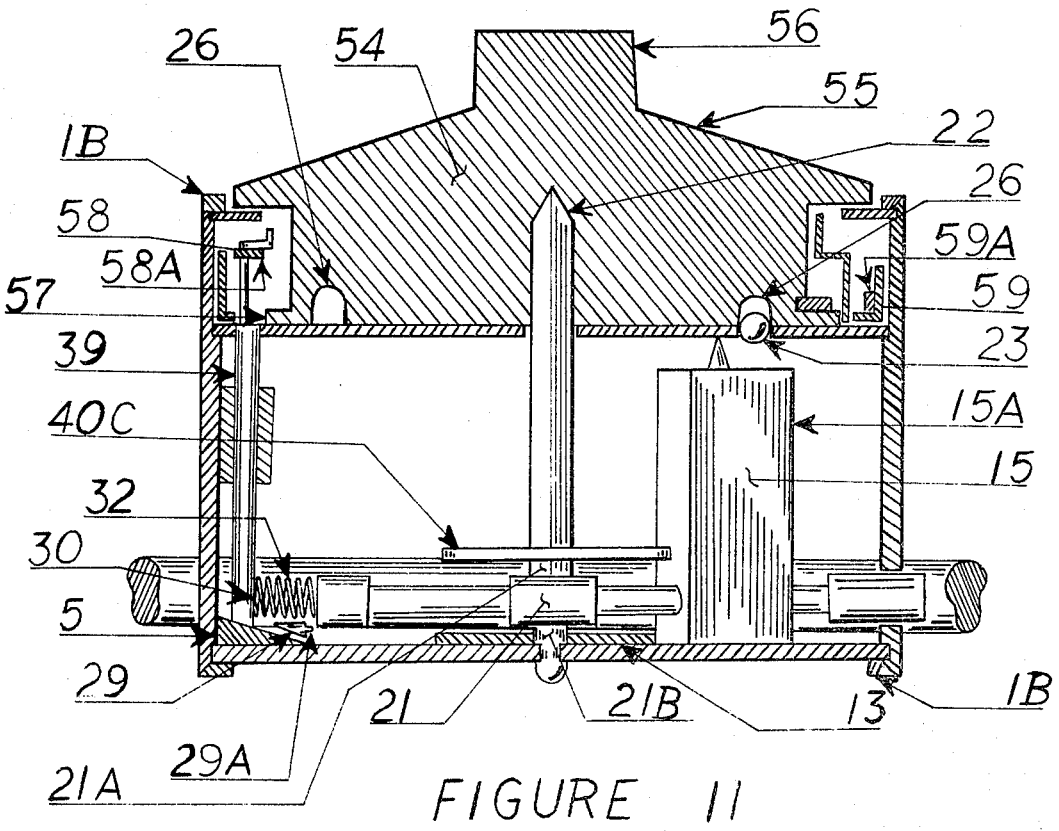

FIG. 11 partly in section and partly in elevation, with right half of case removed, similar to FIG. 10 shows free position of dial stopping ball relative to the dial, master tumblers and ball lifting cam.

Figure 12:
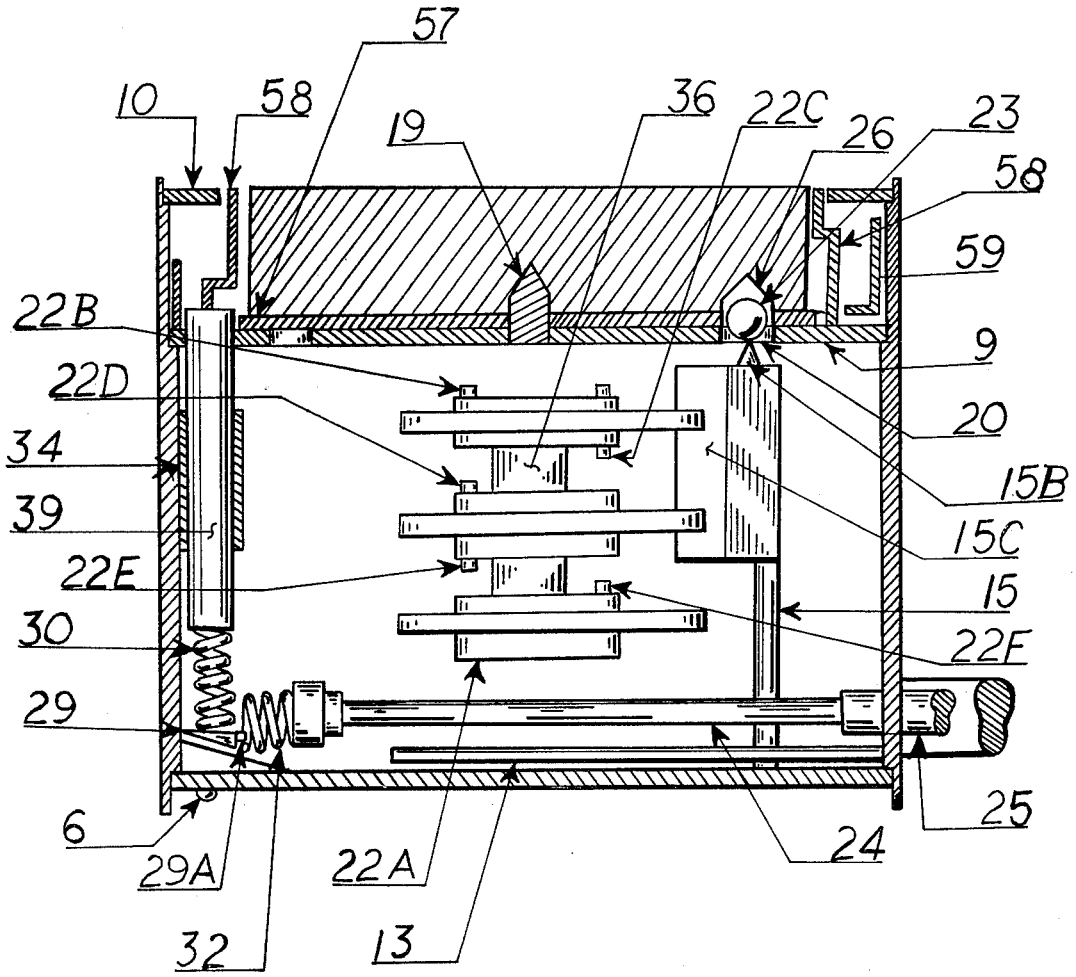

FIG. 12 is similar to FIG. 11, shows dial stopping ball in its second position with the master fence pin lifted into gates of the master tumblers.

The following eight FIGS. 13 to 17*a* illustrate an alternate means for creating positive detect of the dial when plunger is pushed in just prior to contact of fence with the tumblers for the purpose of thwarting attempts to feel out locations of tumbler gates relative to the fence and graduations on the dial face; also illustrated in the following eight FIGS. 13 to 17*a* is an alternate means for creating positive graduation detainer points desirable for both changing the current combination and subsequent dialing of the current and master combination to open the lock; especially useful and practical for night dialing or for blind users.

None of the material herein illustrated or described, or both illustrated and described is intended to limit any of these principals to the precise size, shape and/or position shown and described, but rather to point up and establish basic principals and illustrated means of this invention.

The various principals and features of this invention can be used in any type of lock including door locks where the shackle is commonly called a bolt. The lock shown in the drawings is the exposed shackle padlock type as illustrated by FIGS. 1 through 17*a*.

The various innovative features of this invention can and do apply equally well, together or separately, to any type, kind or style of any lock used for locking anything. No specific kind of material for construction is mentioned herein, thus the material used may be chosen to suit the application.

The lock shown in the drawings is of the exposed shackle padlock type/ having shackle short leg 43*a* and long leg 43*b* extending into casing 1 through round openings 2; long leg 43*b* extensible through shackle guide 11 with open guide plates 11*a* and 11*b* attached thereto; Said long leg can then pass through bottom of the case as 43*c* under certain circumstances when the lock is inset into a door or when used in a closed-in shielded hasp, best seen in FIGS. 1, 2 and 9.

Figure 2:
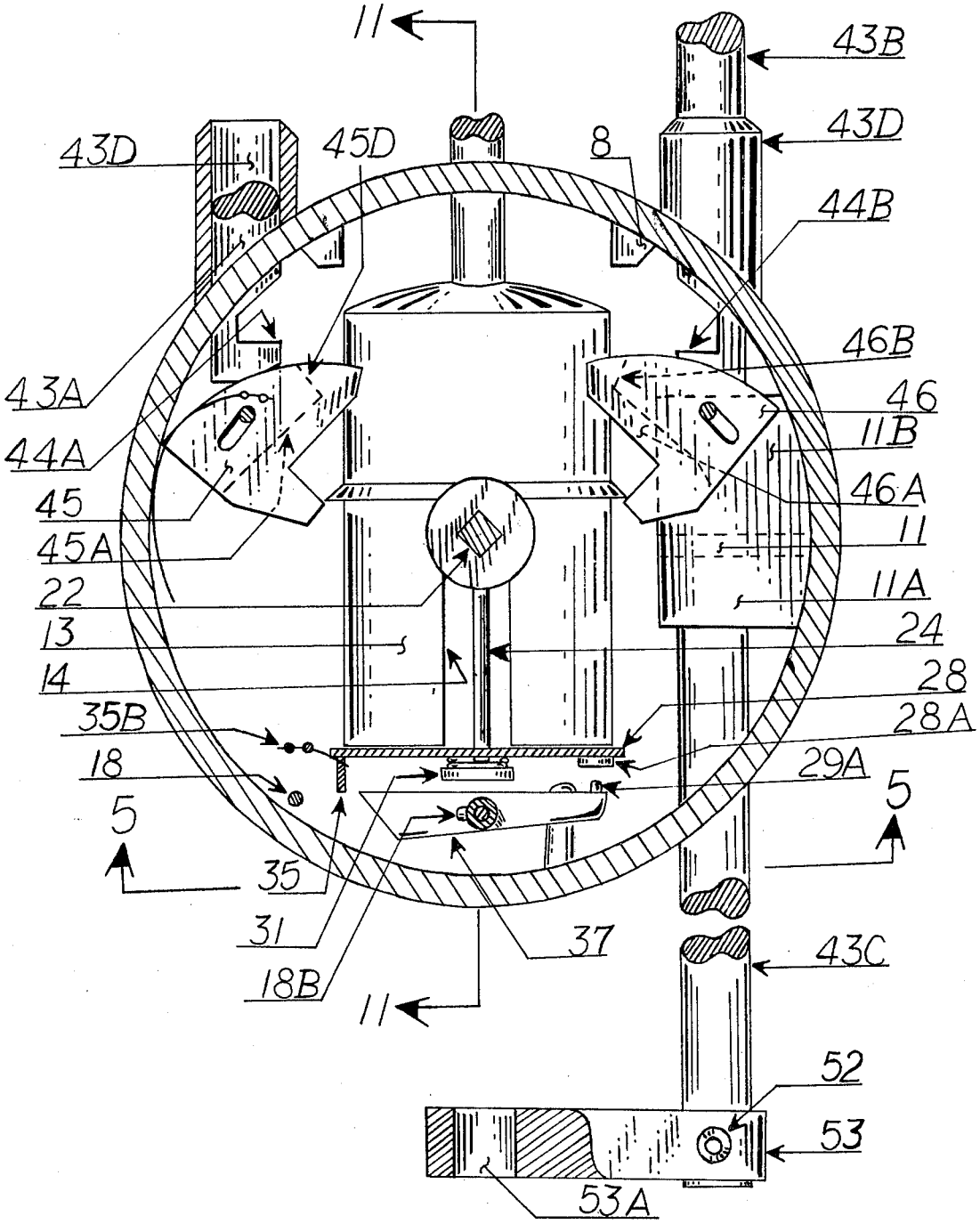
FIG. 2 is similar to FIG. 1 with latching hooks in a second unlocked position, and shackle restrained from being withdrawn by the second stage shackle release pin; also shows long shackle leg passing through the case bottom.

Enlarged portion 43*d* of exposed shackle legs as seen in FIG. 2 serve to thwart attempts by pick-locks to insert shims or other means for influencing locking hooks 45*d* and 46*d* for unauthorized opening or the lock.

Latching members 45 and 46 with hooks 45*a* and 46*a* pivotal on pins 12 and 12*a* that work in lost motion slots 47, FIGS. 2, 1, 7, and 8; said hooks are urged into shackle slots 44*a* and 44*b* per force of springs 49 secured to the latching members at one end and pressed against inside of case at the other end; said latching hooks being composed of solid portions 45*a* and 46*a*, FIGS. 1, 2 and 8, side plates of the hooks 45*b* and 46*b* and unlatching lugs 45*c* and 46*c* and wedge points 48 that wedge in behind anti-pull out blocks 8 when shackle is pulled outward, which motion is permitted by slots 47 of the said side plates, best seen in FIGS. 3, 2, 7, and 8.

The housing of the lock in the embodiment shown includes tubular portion 1, back plate 4, middle bearing plate 9, master tumbler container ring 10 and annular roll over or crimp 1*d*, (an extension of the case) best seen in FIGS. 5, 9 and 10. Said plates 4 and 9 and ring 10 rest upon ledges created by counter bored or enlarged portions of the 1*d*, 1*a*, 1*b*, and 1*c* as shown in FIG. 9, being secured there by rolling over or passing over of said annular case extention case ends 1*d*, as aforesaid, seen in FIG. 10.

Square center shaft 22 is a part of enlarged supporting post 21 which has an undercut at the back of guide center mounting slide plate 13 in slot 14 to contain the slide plate to freely reciprocate against back plate 4; thus said undercut in cooperation with the slot serves to both guide the slide plate laterally and to confine it to reciprocal movement against the back plate as seen in FIGS. 2 and 7, a further reduced portion 21*b* of post 21 passes through hole 7 of plate 4 and is secured thereto, best seen in FIGS. 4, 10, 11 and 1. Locking tumbler 40*c* rests upon guide and support post 21 with spring washer 21*a*, FIGS. 11 and 4, in between as means for pressing the assembled stack of tumblers up against dial shaft flange 60*a*, FIGS. 4 and 10. Between tumbler 40*c* and 40*b*, spacer 36 has a square hole through its center closely fitting square tumbler shaft 22 and serves as an anti-influence spacer between the two tumblers as they are rotated to and fro by the dial lugs 22*b*, 22*c*, 22*e* and 22*f*, FIGS. 6, 12, and 4. Between tumblers 40*b* and 40*l* is a second square hole spacker 36 of the same dimensions and serves the same purpose as the first above mentioned anti-influence spacer.

Figure 3:
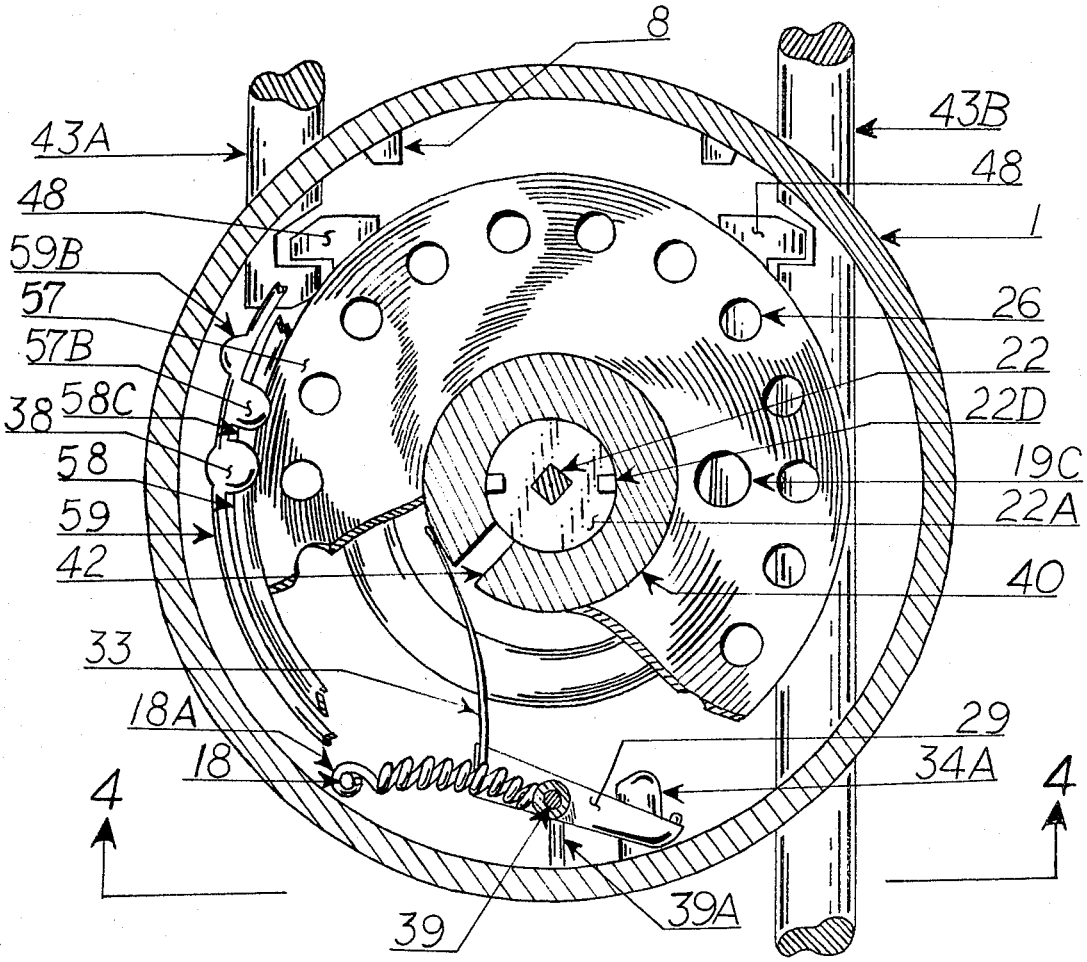
FIG. 3 is a view similar to FIG. 1 with an inner portion of the dial and a small part of the three master tumblers added, showing the disk holding hooks in a second position.

Each tumbler is composed of a disk 40, FIGS. 3 and 4, a front and back disk like hub 22*a*, FIG. 4, each with a short hollow shaft, the smaller fitting inside of the larger; The short hollow shaft of the top disk like hub fitting freely through a center hole in the disks 40, with the top counter part fitting closely through the first hollow shaft until the top disk hub 22*a* comes to contact against the larger disk 40; further pressure then tightens hub 22*a* said hollow shaft stops against the hub of the smaller short hollow shaft at which time the smaller inside (also hollow) slightly larger shaft is riveted or otherwise secured so as to maintain a constant resilient pressure of the two hub disks 22*a* upon the tumbler disk 40; in turn the smaller but slightly longer and riveted short hollow shaft fits freely upon shaft 22 and rotates freely upon its slightly rounded corners.

Thus the larger diameter tumbler disk 40 is frictionally clamped between the two resilient hubs 22*a*; hubs 22*a* as aforsaid have short hollow shafts secured together and thus secured, turn together. Hubs 22*a* being resilient from center shaft to perimeter frictionally clamp disk 40 between the two hubs so that unless forcibly held the disk turns with the hubs; such being the manner whereby the current combination of the locking tumblers 40*a*; 40*b*, and 40*c*, can be changed from time to time after which each set of hubs and disks turn as one to sequentially dial the combination to open the lock.

Tumbler disks 40 have gates 42*b*, FIG. 3 and 4, slightly larger than fence 15*c*, FIGS. 6, 7, and 12 so when current combination is dialed fence 15*c* can enter said gates when plunger 25, (a free fit in hole 3 at top center of case—FIGS. 1 and 8) is pushed in against compression safety spring 16, confined between a first faceward then bottomwards turned portion of said slide 13 to form a boxlike pedestal and spring container 15 and locking bar 17 upon which is mounted fence support post 15*a*; best seen in FIGS. 1, 10, and 12. Thus when the plunger is pushed in preloaded safety spring 16 carries center slide 13, bar 17 and fence 15*c* to contact with hook lugs 45*c* and 46*c*, causing the fence to enter the gates pushing the lugs downward to rotate latching hooks 45*d* and 46*d* inward to accomplish the first stage shackle release, FIG. 2. As above described, prior to pushing in plunger 25 after the current combination has been dialed, slide 13, fence 15*c* and ball 23 occupy a position as seen in FIGS. 6 and 7 with fence support post 15*a* still in contact with outside of case at the top.

In the above described position it will be noted that dial detect ball 23 rests on top of the fence leaving dial 54 free to be rotated to left or right; by the time plunger 25 has pushed slide 13 and fence assembly down to tumbler disks 40, as seen in FIG. 12, fence cam 15*b* has raised ball 23 through guide hole 20 to a point occupying one of the detect pockets 26 in underside of the dial so as to stop all possibility of rotating the dial thus foiling any attempt to feel out location of tumbler gates 42, FIG. 12. The reason ball 23 readily moves into said pockets 26 is due to the lining up effect produced by detection points 61*a* of detection plate 61, figures 4 and 6, having settled into said pockets 61*b* of plate 9, FIGS. 4, 5, and 6. At this point plunger 25 is depressed, moving mounting plate 13, fence 15*c* and cam 15*b* down to a position as seen in FIG. 12. The detection plate is urged into this position by compression spring 54*c* situated in dial spring well 54*b*; detection plate 61 is free to move axialy on dial shaft 60 but is restrained from rotation by a key and keyway between the dial shaft and detainer plate, not shown, which free longitudinal movement of plate 61 is assured by clearance space 54*a* between the plate and dial interior, FIGS. 5 and 6.

If at this point gates 42 have been brought into alignment with fence 15*c*, further pushing in of the plunger moves the fence in to a position shown in FIGS. 2, 10, and 11 with hooks 45*d* and 46*d* withdrawn from shackle notches 44*a* and 44*b* resting, as shown in FIG. 2, upon the inner surface of the shackle legs 43*a* and b, so positioned by a spring back of the shackle, not shown, having moved the shackle upward slightly to a point after release, thus the first stage of opening the lock has been accomplished.

At this point shackle release pin 19 is restraining the shackle from being withdrawn from the lock until the dial is turned to zero or other preselected number at the index on face of the dial. In FIGS. 1, 4, 6, and 14 shackle release pin 19 is seen in relation to slot 50 of the long shackle leg, urged there per force of spring 19*a* pushing down on spring flange 19*b* and up against bearing plate 9; the underside of dial 54 prohibits raising of release pin 19 unless the dial is turned to said preselected number as aforesaid, at which time hole 19*c* as seen in FIGS. 3 and 12 lines up with pin 19 so as to provide a space for the pin to move up into, pulling out on the shackle causes pin 19 to ride up ramp 51 from a position seen in FIG. 4 and 6 to a position as seen in FIGS. 5 and 9; at which time the shackle is completely free to be pulled out. The main object of having to turn the dial to zero is to erase the last number of the combination from showing on the dial face.

When in the locked position with detent ball 23 resting against top of fence 15*c*, dial 54 is free to turn as seen in FIG. 6; at this time the current combination can be dialed to right or left in accordance with which ever direction it was last set, which direction is determined in the embodiment herein illustrated and described, by the direction the dial is turned to set the first number of the current combination.

In this three tumbler embodiment, to dial the current combination the dial is turned at least 2 full turns to the first number of the combination, during which time blunted points 61*a* of detection disk 61 will have dropped into each of the circumferentially spaced pockets 61*b* in the upper sideof bearing plate 9, each diametrically opposite pair of which represent a graduation of the dial face, FIGS. 5, 6 and 10. Upon stopping at the above referred to first number of the combination detection points 61*a* will automatically settle down into the said pockets 61*b*, (FIGS. 4, 10, and 5) to a precise position. During this operation tumblers 40*a* being rotated by the dial per force of a snug fit of two hub lugs 22*b* in holes 44 of the dial shaft flange 60*a*, FIGS. 6 and 10, driving lug 22*c* on underside of tumbler 40*a* will have picked up driven lug 22*d* of middle tumbler 40*b*, in turn then drive lug 22*e* will have picked up driven lug 22*f* on upper side of tumbler 40*c*, after which all three tumblers will turn together to the above said first number of the current combination; then leaving tumbler 40*c* there with its gate 42 in alignment with the fence 15*c*, the dial will be turned one full turn in the opposite direction, with drive lug 22*c* having picked up driven lug 22*d*, and on to the second number of the combination, direction of turning the dial will again be reversed and leaving tumbler 40*b* there, with its gate 42 also in alignment with the fence, will be turned directly to the third number of the combination.

Having dialed the current combination as above described, plunger 25 is then pushed in to unlatch hooks 45*d* and 46*d* from the shackle notches 44*a* and 44*b* as seen in FIG. 2 and hereinbefore described. The latch hooks having been thus released allowing the shackle to spring out slightly per force of a limited kick spring (not shown) the dial is then turned to line the zero up with the index mark at top of lock face, also not shown, to permit shackle release pin 19 to move up ramp 51 onto surface of the shackle long leg, the other end of the release pin having moved up into hole 19*c* of the dial as shackle is pulled out of the lock, best seen in FIGS. 3, 5, and 9.

At this point, however, when the plunger is pushed in to unlatch the hooks, users of the lock can either open the lock as above described or simply hold the plunger in, which of course maintains the fence engaged in the gates 42 of all the tumbler rims 40, as seen in FIGS. 10 and 11. The tumbler disks 40 being thus held from rotation by interference of fence 15*c*, the user can dial a new combination of three numbers precisely in the same manner as above described for dialing the current combination to accomplish the first stage of opening the lock, therefore after thus dialing the third new number the plunger is released and a completely new combination has thus been accomplished. In so changing the combination a user has the perogative of setting the new combination to either right or left, starting with first number, as herein before explained.

During the process of dialing the correct combination to open the lock tumbler hubs 22*a* and frictionally held disks 40 are turned together, where as during combination change the disks are held from rotating by fence 15*c* while the hubs 22*a* are slipped against friction to new selected positions. Due to the thickness of the drive lugs 22*c*, 22*d*, 22*e*, and 22*f*, a combination set in one direction cannot permit the lock to be opened by either systematic or chance dialing in the opposite direction. To dial the current combination or to change the current combination, or as hereinafter described, use of the master combination requires about 20 seconds for an alert user. Inasmuch as detent ball 23 or alternate fence post support lug 23*a*, FIG. 16, serve to insure that at no time can the dial be turned with the fence touching the tumbler disks, and whereas the hubs 22*a* turn freely on the rounded corners of square shaft 22, there exists no chance at any time that any force, interference or friction is ever brought to bear against the tumbler disks; At no time is there anything whatsoever contacting tumbler disks 40 to cause any change (slipping against friction of the hubs) of the relative position of hubs to tumblers; this same feature, of course, also insures against any and all chance of feel or listen out of the gate locations on tumbler disks 40, relative to the dial. Likewise inasmuch as nothing whatsoever touches disks 40 as the dial is turned, no sounds, clicks or tight spots are present to indicate location of the gates.

The combination cannot be changed by anyone except the user as the lock must be in the process of opening (first stage accomplished) before this can be done. Also in this embodiment the master combination must be known and properly dialed in order to actuate internal mechanism in order to stop the locking tumbler disks for slipping of the hubs to preselected positions, in order to line up the gates with the fence to open the lock.

When the current combination has been lost, forgotten or misdialed in changing, the master combination is then dialed to the right or left in accordance with whichever direction it has been preset. The master combination is primarily dialed in precisely the same manner as previously described for dialing the current combination. With this accomplished, the plunger 25 is turned slightly clockwise or counter-clockwise as preset in manufacture (counter-clockwise in this embodiment) and pushed all the way in and then released; Which action has caused the plunger to push the center mounting slide plate 13 in until fence 15*c* comes to bear against tumblers 40, safety spring 16 then compresses further than normal and moves actuating rod 24 and master fence pin actuating arm 28 with it, best seen in FIG. 12.

Turning of plunger 25 and pushing in as above described serves to turn arm 28 down from position seen in FIG. 5 to the position seen in FIG. 4 which places push and safety spring 32, secured into cup 28*a*, in alignment with knob 29*a* on top edge of master pin lift arm 29.

When the plunger is then pushed in arm 29, secured to master fence pin 39, rides up ramp 5 to lift master fence pin 39 into composit master fence gate 38, which segments form composit hole 38 for receiving master pin 39, when the master combination is properly dialed as seen in FIGS. 3 and 12. Thus arm 29 is moved from the position shown in FIG. 1 to position shown in FIG. 3 with master fence pin raised from the position in FIG. 11 to the position shown in FIG. 12. When plunger 25 is turned counter clockwise as aforesaid, spring 32 in cup 28*a* is then brought into alignment with knob 29*a* on master fence lift arm 29. Master tumbler fence pin 39 is rotatably positioned in direct alignment with master actuating rod 24 near case bottom 4 which rod is in a bearing guide hole 3*a* through post 21, said pin 39 centered at the middle master tumbler 58, running thence perpendicularly distant thereto from center bearing pin 6 secured into back case plate 4; pin 6 in turn extends at right angles to said plate 4 into a free fitting hole centered in master pin 39 to serve as an internal bearing and guide for pin 39, pin 39 then rotates and moves axialy as above explained.

As arm 29 is urged up ramp 5 by compression spring 32, lifting pin 39 into the composit master tumbler gate hole 38 as seen in FIGS. 3 and 12, sleeve 34 will have been rotated with it by action of small pin 39*a*, secured into fence pin 39 at right angles thereto, moving against the right hand side of rectangular lost motion slot 34*a* in sleeve 34 as seen in FIG. 3; which action rotates sleeve 34 sufficiently to activate toggle spring 18*a*, pivotal on pin 18, to throw knob 18*b* and sleeve 34 together with hook mounting arm 37 clockwise so as to move resilient hooks 33 from the out of use position shown in FIG. 1 to the position shown in FIG. 3 bearing against tumbler disks 40, to be maintained there per force of toggle spring 18*a*. Lost motion slot 34*a* must have sufficient width to permit axail movement of pin 39*a* secured into master fence pin 39. The plunger is then released and returned to starting position together with center slide 13 and its attached parts by return spring 27; arm 29 is moved back down ramp 5 per force of spring 30 pushing upwards on sleeve 34 and downwards on arm 29 which carries fence pin 39 down to out of contact position as seen in FIGS. 1, 2, and 11. Small pin 39*a* then has moved freely in lost motion rectangular slot both counterclockwise and downward leaving hooks 33 pressed against tumbler disks 40 as seen in FIG. 3.

Composite master tumbler gate hole 38 is shown in position at the left side of FIG. 3 as illustrative (for practical reasons) rather than at the bottom of FIG. 3 in its proper operating position over fence pin 39; the crescent shaped hole just above hole 38 represents gate segment 57*b* of tumbler rim 57 and gate 58*c* in alignment one with the other, gate segment 59*b* of tumbler 59 is shown as a smaller crescent one graduation out of alignment above the first two gates mentioned. In any event, when the master combination is properly dialed the composite hole 38 being larger than pin 39 and when so aligned over pin 39 readily receives the pin when plunger 25 is pushed in as aforesaid.

At this point the dial is turned at least two full turns in whichever direction the master mechanism has been built to operate, during which time the hub lugs hereinbefore described have picked up all hub lugs and locking tumblers 40 which all turn together; as gates 42 of the disks 40 arrive at resiliant hooks 33 the knob on the hooks, each in turn, drop into gates 42 of disks 40, arresting rotation of disks and all three hubs slip on the disks to a preselected number indicated on the dial relative to the index mark; the plunger is then pushed straight in (spring 35*a* FIG. 2 has rotated arm 28 back to a normal operating position) release rod 35 then is lined up with and strikes a lower solid portion of mounting arm 37 reactivating toggle spring 18*a* to throw knob 18*b* back to a normal restive position with hooks 33 withdrawn from gates 42 of the disks 40 as seen in FIG. 1. The dial is then turned on to zero carrying all the tumblers with it to align gates 42 with fence 15*c*, at which time the plunger is again depressed (pushed in) to release hooks 45*d* and 46*d* as shown in FIG. 2; zero then being already lined up at the index mark, pin 19 is free as previously described and lock is fully open. As seen in FIGS. 2, 5, and 6. When the plunger 25 is pushed straight in arm 28 is normally in a position seen in FIG. 5 per force of spring 35*a* bearing downward on release rod 35 during which operation safety spring 32, FIGS. 1 and 11, passes over arm 29 and release rod 35, FIGS. 2, 5, and 11, is in a position to strike a solid portion of mounting arm 37. This described position of arm 28 prevails at all times when current combination is dialed to open the locks, if however, plunger 25 is inadvertantly rotated when plunger is pushed in (above discribed as being the proceedure followed when the master combination is dialed) no damage is done because safety spring 32 simply compresses and release rod 35 harmlessly passes through provided opening 34*b* of arm 37, as seen in FIGS. 2, 5, and 11. On the other hand when the master combination is dialed and plunger 25 is rotated so as to position arm 28 as seen in FIG. 4, spring 32 picks up knob 29*a*, FIGS. 1 and 12, to push arm 29 up ramp 5 and release rod 35 permits this action by passing through opening 34*b* through hook arm 37, as seen in FIG. 5. In the event, however, that the master tumblers have not been properly dialed and arm 29 is restrained from moving up ramp 5, no damage is done because compression spring 32 compensates by compressing far enough to permit this abortive action to occur, as seen in FIG. 2. Safety spring 16 serves in this same capacity when the current combination is misdialed and the plunger is pushed all the way in: Compression spring 16 simply compensates by compressing further than normally pre-loaded to operate the slide.

The alternate means for accomplishing graduation detection and dial pause as illustrated by FIGS. 13 through 17*a* are self-explanatory for the most part, however the following more pointed description may be useful in following out the action of these features.

As seen in FIGS. 14, 15, and 16 graduation detection rollers 65, free turning on pins 65*c*, are poised to roll into pockets 63*a* in rim 63 of dial shaft flange 62 as the dial is rotated; thus close scrutiny of the dial face is not required in order to accomplish precise dialing. Arms 65*a* pivotal on pins 65*b* secured to plate 9 are pulled up inwardly by tension spring 66 secured to the case by rivet pins 66*a* bearing against arms 65*a* at opposite end.

As seen in FIG. 16 fence lug 23*a* is so positioned at the perimeter of flange rim 63 so that the slightest inward movement of plunger 25 will cause said lug to enter one of the slots 62*a* of the rim and stop the dial from rotation before fence 15*c* touches locking tumblers 40; in the event, however, gates 42 are aligned with fence 15*c* lug 23*a* will pass through slots 62*a* of rim 63 into the open interior below flange 62 and the dial will again be free to rotate should a change of the current combination be desired at this point.

Note in FIG. 14 that shackle release pin 19 and notch 50 are located further towards top of the lock in order for pin 19 to have access to the dial hole 19*c* outside of rim 63; location of hole 19*c* in the dial then would also have to be changed to a suitable position in the dial.

From the foregoing, it will be seen that this invention is one well adapted to attain all of the ends and objects hereinabove set forth, together with other advantages which are obvious and which are inherent to the method and structure.

It will be undstood that certain features and subcombinations are of utility and may be employed without reference to other features and subcombinations. This is contemplated by and is within the scope of the claims.

As many possible embodiments may be made of the apparatus and method of this invention without departing from the scope thereof, it is to be understood that all matter herein set forth or shown in the accompanying drawings is to be interpreted as illustrative and not in a limiting sense.

The invention having been described, what is claimed is:

1. A combination lock comprising a looped shackle movable between a first locked position, a second unlocked holding position and a third fully released position after zero, or some other preselected number on the dial face has been rotated to an index mark on front side of the case, said holding means being a guided pin engaged with a slot in long leg of the shackle releasable into an apeture on under side of the dial; locking means movable into and out of engagement with provided notches in legs of the shackle; said locking means being composed of solid latching hooks at the top end, with unlocking lugs at the bottom end, having sides provided with lost motion slots therein to accomodate stationary pivot pins secured to parts of the case, fence means including a fence for moving the locking means out of locking engagement with said notches of the shackle; a calibrated dial rotatable on a common axis with a plurality of locking tumblers mounted axially on a centrally located shaft perpendicular to face of the dial; means for sequentially rotating said tumblers to and fro for aligning the gates of all the tumblers with the fence, for movement of said fence into said gates for moving the locking means out of engagement with said notches of the shackle, said gates being located on the perifery of outer disks of the tumblers, frictionally held to inner hubs of the tumblers to allow provided driving means between the dial and tumbler hubs to new selected positions relative to gates of the dial; means for dialing and activating a master tumbler means for stopping all the disks of the said locking tumblers for slipping all of the said hubs to a preselected number on the dial face; and means for releasing the said disks preparatory to rotating with the fence for opening of the lock; means for pivoting the locking means into deeper engagement with notches in the shackle legs if and as the shackle is vigorously pulled outward of the case while the locking means is engaged with notches of the shackle leg; and means for wedging the locking means tighter into notches of the shackle legs if the shackle is forcefully pulled outward against inner surface of the case when the locking means is engaged with the shackle notches as aforesaid; means for detecting each circumferentially spaced graduation on the dial face as the dial is rotated and means for effecting a discernable pause at each such graduation, thus diminishing meed for close scrutiny of the dial face in so doing; means for blocking the dial from rotation prior to contact of the fence with disk rims of the tumblers thus foiling all attempts by pick-locks for feeling or listening out positions of tumbler disk gates relative to the fence; means for providing a guided mounting slide plate with a preloaded safety compression spring operable between an unlatching bar secured to said slide plate and an actuating finger plunger passing through a hole in an upturned end of said slide plate and confined therein by a flange at inside end of the plunger, said spring being only partly compressed, will compress further when internal parts are not properly positioned to function, thus serving to protect internal mechanism of the lock from damage; a portion of the upturned slide plate is then turned inward to form a flat pedestal upon which the fence means is mounted; compressive spring return means are provided at the opposite end of the slide plate; which return spring functions between a spring well cup secured to back case plate aligned with the end of a master combination means actuating rod (secured to the said plunger at top end of the case) which spring then activates a master actuating means near bottom end of the case, said rod being rotatable and axially guided by hole through the locking tumbler shaft mounting post; means are provided for bringing a provided compression spring in to alignment with the afore mentioned master actuating knob on an arm; and means for lifting the master fence pin and rotating a provided sleeve independantly rotatable on the master fence pin; after said means has moved said lift arm a given distance up the said ramp the said sleeve being rotatable by a provided pin secured into the said master fence pin activates a toggle spring for rotating said sleeve clockwise leaving the drive pin and master fence lift arm behind, due to a lost motion rectangular slot in which the said pin operates, through said means a set of locking tumbler disk stopping hooks are resiliently brought to bear against the locking tumbler disks; after the said disk stopping hooks have served to slip the disks to a preselected position as aforesaid; means are provided for reactivating said toggle spring to throw the toggle spring in the opposite direction for withdrawing the said hooks from engagement with the gates of said disks; means for providing enlarged portions of the shackle legs outside of and close to the case when the shackle is in its locked position for the purpose of foiling attemps by pick-locks to gain access to internal parts of the lock through use of any type or thickness of tool or instrument for the purpose of unlatching the hooks, which in conjunction with shape and location of the hook ends and unlocking lugs at lower end of the latching members make such an accomplishment vertually impossible; means whereby latching of the shackle holding hooks function independantly one from the other, thus in the event a pick-lock devises means for disengaging one hook from the shackle, the other hook is not effected thereby.

2. The lock of claim 1, further provide with latching members having solid innermost portions formed as locking hooks receivable into locking notches of the shackle legs at the top end with a rounded outer side and a beveled inner side matching both contour of the case wall and provided wedge blocks secured to the case wall between the said shackle legs, said solid portions having inwardly turned unlatching lugs at the opposite end of the said latching members below a provided unlatching bar secured to a guided mounting slide plate manually movable by a safety spring loaded plunger extending out through the case wall at top of the lock; means associated with lost motion slots in the said latching members for permitting the said latching hooks to both pivot deeper into said notches and move upwardly with the shackle on stationary pivot pins secured to the case; means for beveled ends of the hooks to engage provided wedge blocks for further tightening of the hooks into said notches of the shackle legs; and provided spring means for engaging the said hooks with the said notches.

3. The lock of claim 1, further provided with a manually unlocking means comprising an external plunger extending into the case, a centrally located mounting slide plate, an unlatching bar secured to the said mounting slide plate, a preloaded safety spring confined between said plunger and said unlatching bar and a fence secured to an elevated portion of the said mounting slide plate; means for moving the fence between first, second and third positions; means for moving the assembled slide directly from the first position to the third position to pivot provided latching hooks out of engagement with the shackle when all of the tumbler gates are positioned to receive the fence; means for safeguarding internal mechanism of the lock against damage when the said plunger is fully depressed before gates of the tumblers have been aligned to receive the fence, which means has stopped inward movement of the assembled mounting slide plate at its second position; means for moving the plunger to its third fully depressed position to activate a master combination tumbler means for opening the lock when the current combination is not available and means for safeguarding the said master means from damage when gates of the master tumblers are not aligned to receive a provided master fence pin.

4. The lock of claim 3, comprising a plunger activating rod extending from the exterior at top of case and means attached thereto for depressing and torqueing of said rod, which rod passes through a hole in the case top and through an upturned portion of the mounting slide plate thence through a free fitting hole in the unlatching bar and on through a provided free hole in the tumbler mounting post, said rod then passes through a master tumbler actuating arm attached firmly thereto and rotatable therewith, said arm located adjacent to said mounting post, said rod having passed through said arm a distance sufficiently to mount a slide return coil compression spring upon the so extended terminal end of said rod, said slide plate return spring extending from and bearing resiliently against said arm downward of the lock and into a spring guide cup secured to back of the case in which cup, said spring is also secured; the aforesaid master actuating arm secured to plunger rod extends to the right and to the left at right angles to said rod and mounts a compensating compression coil spring engaged with a spring receiving knob positioned on the master pin ramp arm of the master tumbler means, said ramp arm being firmly attached to back end of the master fence pin rotatable upon an internal bearing pin secured in case back, and forewardly spiraling master fence pin lift arm ramp upon which said ramp arm functions, a disk stopping hooks mounting arm located on the side of afore-stated sleeve opposite of said ramp arm, a toggle spring knob is attached to said sleeve adjacent to said disk stopping hooks arms, a toggle spring is mounted between said toggle spring knob and a toggle spring pivot pin secured into the back plate of the case in conjunction with use of the master combination means tumbler disk stopping hooks, means are provided for mounting said tumbler disk stopping hooks to said mounting arm, which arm is firmly attached to the afore-said rotatable sleeve as herein above set forth; a master hooks release rod is located in direct alignment with the leading edge of the disk stopping mounting arm.

5. The lock of claim 4, further provided with means for actuating the master combination tumbler means if the current combination is lost or forgotten, comprising a plurality of tumbler rings adjacent the perifery of the dial on a common plane with an inner flange of the dial, which flange constitutes the center most master tumbler, each such tumbler having a notch in its edge serving as a gate for receiving a fence pin, a middle bearing plate upon which the dial and tumblers rotate, a rotatable and axially movable master fence pin, a rotatable sleeve mounted on the said fence pin, a master pin lifting ramp arm secured to the back end of the fence pin, said arm having a knob on its inner edge for receiving an actuating spring, a spiraling ramp secured to back plate of the case adjacent to said fence pin, a master fence pin return spring mounted on the fence pin between the said sleeve and pin lifting arm, a rectangular lost motion slot in the said sleeve; a toggle spring actuating pin secured into said fence pin movable within said lost motion slot; a plurality of locking tumbler disk stopping hooks, an elongated arm attached to one side of said sleeve to which said disk stopping hooks are secured, a toggle spring with one end acting against said sleeve for rotating said disk stopping hooks into and out of engagement with said locking tumbler disks with opposite end of said toggle spring pivotal upon a provided pin secured into back case plate; and means for actuating each of the referred to parts and means for using the master combination means for opening the lock.

6. The lock of claim 3, a shackle release means wherein the shackle is releasable from its second position, a shackle release pin positioned in the middle bearing plate and flush with the outer surface of said bearing plate, extending inwardly to contact the bottom of a slot in the long leg of said shackle, the said slot having the inwardly end beveled to constitute a pin ride out ramp and said release pin being radiused at the lower end to approximate said bevel at the end of said ramp, a coiled compression spring is mounted on said shackle release pin between a flange at the lower end of said pin and the inside surface of said middle bearing plate to urge said pin to remain at the bottom of said slot when the shackle is in its first and second positions the inner surface of the dial inhibits said pin from rising out of said slot when any attempt is made to withdraw said shackle while in its second position, a means provided to rotate the dial to a preselected position to release the shackle, a hole in the underside of the dial is so positioned that when the dial is dialed on to zero in the same direction as last dialed the hole up in the dial is positioned in direct alignment with said shackle release pin at which point shackle can be withdrawn where at the said beveled end of said pin will readily move up said slot ramp as pin moves up in to the so provided hole in the dial; the object of the shackle release pin is to provide a compulsary removal of the last number of the combination dialed for the protection of the user against combination discovery, also means are provided to include a shackle with a longer than normal shackle long leg extensible through a hole in the bottom of the case sufficiently longer to accomodate a dead bolt member to be attached to said longer leg to readily convert the lock in this embodiment to a door lock in manufacture wherein the only change would be a shackle with a longer leg than ordinarily provided to receive said dead bolt member as well as said hole in the bottom of the case for the long shackle dead bolt to pass through.

7. The lock of claim 1, further provides means for detecting each graduation shown on the dial face and to cause the dial to pause at each such graduation, said means comprising a centrally located shaft extending inward from the dial through a middle bearing plate secured to the outer case, which shaft has a flange at its inner end just back of said brearing plate for holding the dial to the lock case so the dial and shaft would then be rotatable together; a disk keyed to the said shaft and rotatable therewith in a provided clearance hole on underside of the dial being axially movable on said shaft having a plurality of inwardly turned blunted points at its perimeter urged into shallow pockets on front side of said bearing plate by a provided light weight compression spring positioned in a provided spring well above said disk, there being as many such pockets as graduations shown on the dial face.

8. The lock of claim 1, further provided with a second (alternate) means for detecting each graduation shown on the dial face and to cause the dial to pause at each such graduation; said means comprising a centrally located shaft extending inward from the dial and rotatable therewith passes through a middle bearing plate secured to the outer case, which shaft has a tumbler driving flange at its inner end just back of said bearing plate serving also as a means for holding the dial in an axially constant position relative to the lock case; thereby the dial and shaft are rotatably joined together; said flange has an inwardly turned rim at its periphery with circumferentially spaced slots cut through it, the number of which equate the number of graduations shown on face of the dial, said slots passing only through the rim and in no way into the said flange; the said flange then has shallow crescent shaped pockets spaced around its perifery the width of which correspond precisely with the width of the afore-said slots through the rim (one pocket above each such slot); a pair of provided rollers on pins secured through one end of short arms pivotal on the under side of said bearing plate at opposite sides of said flange provided with inwardly bearing spring means secured to the inner case.

9. The lock of claim 1, further provided with an anti-feel out and listen out means comprising a fence movable between first, second and third positions, a cam secured to front end of the fence having a height one-half the diameter of a ball, a middle bearing plate of the lock in front of said cam leaving minimum clearance between the two, said bearing plate having a hole through it in alignment with vertical movement of said fence, a free fitting ball twice the thickness of the bearing plate movable between first, second and third positions relative to the cam, a plurality of circumferentially spaced pockets in back side of the dial in alignment with said ball in said free fitting hole through said bearing plate, there being as many such pockets as graduations on face of the dial; prior to depressing the plunger said ball is at rest against front end of the fence below the said cam at first position of both the fence and ball; when then the plunger has been depressed, with gates of the locking disks unaligned, the fence will have moved inward to its second position with the ball also occupying a second position at the apex of said cam with the foreward edge pressed into one of said pockets on underside of the dial, thus the dial will have been stopped from rotation well in advance of contact between the fence and tumbler disks; if however, gates of the disks had all been aligned for receiving the fence, pushing in the plunger would have moved the fence directly from a first position deeply engaged with the locking tumbler disk gates where at the latching hooks occupy an unlatched position, and the ball would occupy a third position above the said cam, where at the fence is in a position for combination change or at this point provided means for releasing the shackle.

10. The lock of claim 8, further provided with a second (alternate) anti-feel and listen out means comprising a fence means including a fence movable between a first, second and third position, a dial means rotatable with the dial shaft said dial shaft extending through a middle bearing plate to and part of a locking tumbler driving flange means which flange is adjacent to and rotatably mounted against said middle bearing plate, said tumbler driving means being two holes into inner surface of said flange so positioned to receive the driven lugs of the hub of the front locking tumbler, the anti-feel and listen out means being a plurality of circumferentially spaced slots cut through an inwardly turned rim on the perimeter of said flange, there being the same number of slots through said inwardly turned rim as there are graduations on face of said dial, also a part of said means above referred to is a lug secured to the front end of said fence, said lug is positioned to remain above and clear of said inwardly turned rim when the fence is in the first position of the fence means, thus permitting free rotation of said dial and said slotted rim, in the second position of the fence means the said lug on the fence has entered one of the slots sufficiently to block rotation of the dial where in the fence of the fence means has not yet contacted the said perimeter of the tumblers, thereby prohibiting all attempts to feel or listen out the tumbler gates positions relative to the dial and fence; means are further provided whereby with the said lug blocking further rotation of the dial and in this position, if said position of said lug has been attained and the fence means cooperating with the dialing means has so positioned the gates of the tumblers to receive the fence, the third position of the unlatching means is then attainable; at the said third position of the fence means also provided are means to rotate the dial freely, the inside of the said locking tumbler driving flange being recessed to the depth of said inwardly turned slotted rim providing an open area for said lug on said fence, after said lug has primarily performed its dial stopping anti-feel and listen out purpose and said lug having passed through said slotted rim, the dialing means set forth herein before can be used to dial a new current combination.

* * * * *